US008444808B2

(12) United States Patent
Koslow et al.

(10) Patent No.: US 8,444,808 B2
(45) Date of Patent: May 21, 2013

(54) PROCESS FOR PRODUCING NANOFIBERS

(75) Inventors: Evan E Koslow, Fairfield, CT (US); Anil C Suthar, West Windsor, NJ (US)

(73) Assignee: KX Industries, LP, Orange, CT (US)

( * ) Notice: Subject to any disclaimer, the term of this patent is extended or adjusted under 35 U.S.C. 154(b) by 1473 days.

(21) Appl. No.: 11/694,087

(22) Filed: Mar. 30, 2007

(65) Prior Publication Data

US 2008/0057307 A1 Mar. 6, 2008

Related U.S. Application Data

(60) Provisional application No. 60/842,069, filed on Aug. 31, 2006.

(51) Int. Cl.
*D21C 9/00* (2006.01)

(52) U.S. Cl.
USPC ..... 162/9; 162/261; 241/28

(58) Field of Classification Search
USPC ..... 162/9, 261
See application file for complete search history.

(56) References Cited

U.S. PATENT DOCUMENTS

| | | | | |
|---|---|---|---|---|
| 2,810,646 | A | 10/1957 | Wooding et al. | |
| 3,950,473 | A | 4/1976 | Iwahori et al. | |
| 3,997,648 | A * | 12/1976 | Davis et al. | 264/140 |
| 4,166,584 | A * | 9/1979 | Asplund | 241/261.3 |
| 4,459,332 | A | 7/1984 | Giglia | |
| 4,495,030 | A | 1/1985 | Giglia | |
| 4,565,727 | A | 1/1986 | Giglia et al. | |
| 4,761,203 | A | 8/1988 | Vinson | |
| 4,811,908 | A | 3/1989 | Galati | |
| 4,828,698 | A | 5/1989 | Jewell et al. | |
| 4,904,343 | A | 2/1990 | Giglia et al. | |
| 4,929,502 | A | 5/1990 | Giglia | |
| 5,019,311 | A | 5/1991 | Koslow | |
| 5,084,136 | A | 1/1992 | Haines et al. | |
| 5,180,630 | A | 1/1993 | Giglia | |
| 5,335,865 | A * | 8/1994 | Kohler et al. | 241/28 |
| 6,183,596 | B1 | 2/2001 | Matsuda | |

(Continued)

FOREIGN PATENT DOCUMENTS

GB 2296726 7/1996

OTHER PUBLICATIONS

Fang Qiao, Kalman Migler, Donald Hunston, Charles Han, Reactive Compatibilization and In-line Morphological Analysis of Blends of PET and a Thermotropic Liquid Crystalline Polymer, Polymer Engineering and Science, Jan. 2001, vol. 41, No. 1.

*Primary Examiner* — Jacob Thomas Minskey
(74) *Attorney, Agent, or Firm* — DeLio & Peterson, LLC; Peter W. Peterson; Robert Curcio

(57) ABSTRACT

A process for making nanofibers includes preparing a fluid suspension of fibers, shear refining the fibers to create fibrillated fibers, and subsequently closed channel refining or homogenizing the fibrillated fibers to detach nanofibers from the fibrillated fibers. The shear refining of the fibers in the fluid suspension generates fiber cores having attached nanofibers. The closed channel refining or homogenizing of the fibrillated fibers is initially at a first shear rate and, subsequently, at a second, higher shear rate, to detach nanofibers from fiber cores and to create additional nanofibers from the fiber cores. The fiber suspension may flow continuously from the shear refining to the closed channel refining or homogenizing, and include controlling the rate of flow of the fiber suspension from the shear refining to the closed channel refining or homogenizing.

26 Claims, 7 Drawing Sheets

U.S. PATENT DOCUMENTS

| | | | | |
|---|---|---|---|---|
| 6,660,172 | B2 | 12/2003 | Koslow | |
| 6,835,311 | B2 | 12/2004 | Koslow | |
| 6,866,704 | B2 | 3/2005 | Koslow | |
| 6,872,311 | B2 | 3/2005 | Koslow | |
| 7,566,014 | B2 * | 7/2009 | Koslow et al. | 241/21 |
| 2001/0020306 | A1 | 9/2001 | Leibnitz et al. | |
| 2002/0053753 | A1 * | 5/2002 | Zumbrunnen et al. | 264/171.1 |
| 2004/0178142 | A1 | 9/2004 | Koslow | |
| 2005/0051487 | A1 | 3/2005 | Koslow | |
| 2005/0142973 | A1 | 6/2005 | Bletsos | |
| 2005/0284595 | A1 | 12/2005 | Conley | |
| 2006/0063882 | A1 * | 3/2006 | Velev et al. | 524/543 |
| 2006/0162879 | A1 | 7/2006 | Tinker | |

* cited by examiner

PROCESS FOR PRODUCING NANOFIBERS

BACKGROUND OF THE INVENTION

1. Field of the Invention

This invention relates to the production of fibers and, in particular, to production of nanometer-sized fibers.

2. Description of Related Art

The production of fibrillated fibers is known from, among others, U.S. Pat. Nos. 2,810,646; 4,495,030; 4,565,727; 4,904,343; 4,929,502 and 5,180,630. Methods used to make such fibrillated fibers have included the use of commercial papermaking machinery and commercial blenders. There is a need to efficiently mass-produce nanometer-sized fibers at lower cost for various applications, but such prior art methods and equipment have not proved effective for such purposes.

SUMMARY OF THE INVENTION

Bearing in mind the problems and deficiencies of the prior art, it is therefore an object of the present invention to provide an improved process and system for producing nanometer-sized fibers and fibrils.

It is another object of the present invention to provide a process and system for producing nanometer-sized fibers having substantially reduced fiber cores mixed therein.

Yet another object of the present invention is to provide a process and system for producing nanometer-sized fibers with improved character, i.e., having greater uniformity and flowability.

A further object of the invention is to provide a process and system for producing nanometer-sized fibers that is more energy efficient and productive than prior methods, and results in improved volume and yield.

Still other objects and advantages of the invention will in part be obvious and will in part be apparent from the specification.

The above and other objects, which will be apparent to those skilled in the art, are achieved in the present invention which is directed to a process for making nanofibers comprising preparing a fluid suspension of fibers, shear refining the fibers to create fibrillated fibers, and subsequently closed channel refining or homogenizing the fibrillated fibers to detach nanofibers from the fibrillated fibers.

The shear refining of the fibers in the fluid suspension generates fiber cores having attached nanofibers, and the closed channel refining or homogenizing detaches the nanofibers from the fiber cores. The fiber suspension may flow continuously from the shear refining to the closed channel refining or homogenizing, and include controlling the rate of flow of the fiber suspension from the shear refining to the closed channel refining or homogenizing.

The process may further include substantially separating the detached nanofibers from remaining fibrillated or core fibers. The closed channel refining or homogenizing may continue to additionally create nanofibers from the remaining fiber cores.

Where closed channel refining is employed, it may be performed initially at a first shear rate and, subsequently, at a second, higher shear rate to detach nanofibers from the fibrillated fibers, leaving fiber cores, and to create additional nanofibers from the fiber cores. Such closed channel refining of the fibrillated fibers may be by shearing, crushing, beating and cutting the fibrillated fibers.

The process may further include removing from the fiber suspension heat generated during the shear refining, closed channel refining or homogenizing.

In another aspect, the present invention is directed to a process for making nanofibers comprising preparing a fluid suspension of fibrillated fibers comprising fiber cores having attached nanofibers, and closed channel refining or homogenizing the fibrillated fibers initially at a first shear rate and, subsequently, at a second, higher shear rate to detach nanofibers from fiber cores and to create additional nanofibers from the fiber cores.

The fiber suspension may flow, preferably continuously and in series, from a first rotor operating at the first shear rate to a second rotor operating at the second shear rate. The process may also include controlling the rate of flow of the fiber suspension.

The closed channel refining may be performed by passing the fiber suspension between teeth that move relative to one another, the teeth being spaced to impart sufficient shear forces on the fibers in the fiber suspension to detach nanofibers from the fibrillated fibers and optionally create additional nanofibers from the fiber cores.

The homogenizing may be performed by pressurizing the fiber suspension and passing the pressurized fiber suspension through an orifice of a size and at a pressure to impart sufficient shear forces on the fibers in the fiber suspension to detach nanofibers from the fibrillated fibers and optionally create additional nanofibers from the fiber cores.

In yet another aspect, the present invention is directed to a fiber composition comprising a mixture of fiber cores and nanofibers detached from the fiber cores, the fiber cores having a diameter of about 500-5000 nm and a length of about 0.1-6 mm and the nanofibers having a diameter of about 50-500 nm and a length of about 0.1-6 mm. The invention is also directed to a fiber composition comprising nanofibers substantially free of fiber cores, the nanofibers having a diameter of about 50-500 nm and a length of about 0.1-6 mm.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which.

DESCRIPTION OF THE PREFERRED EMBODIMENT(S)

Figure 1:
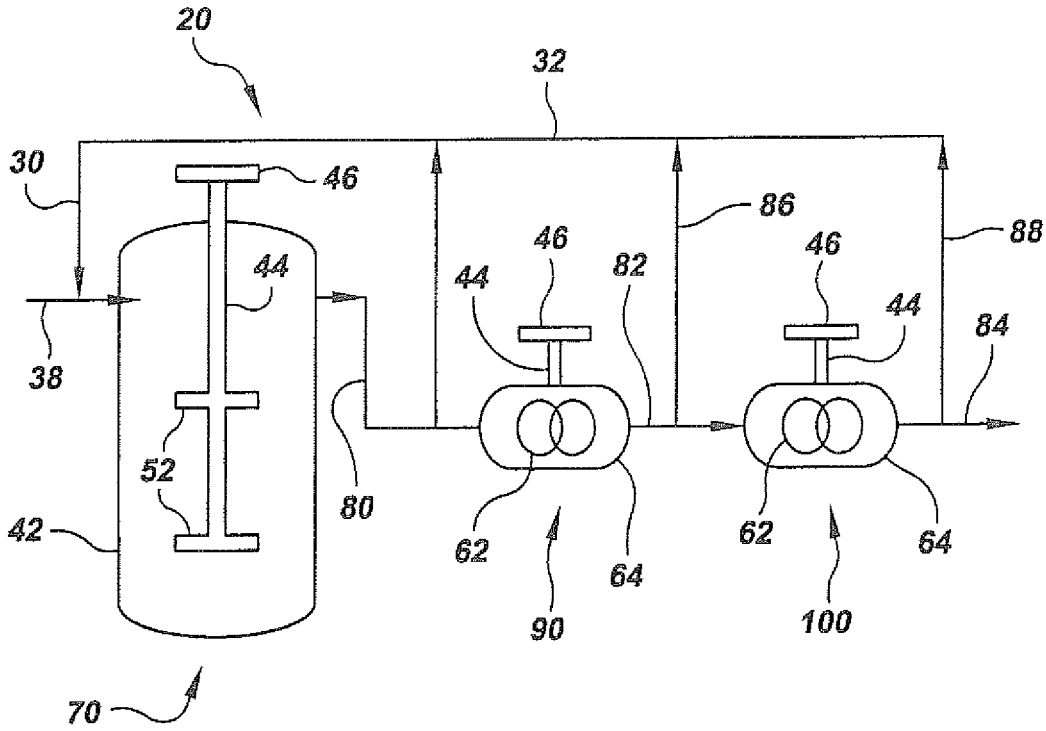
FIG. 1 is a side elevational view in cross section of the preferred system of open and closed channel refiners used to produce nanofibers in accordance with the present invention.

In describing the preferred embodiment of the present invention, reference will be made herein to FIGS. 1-10 of the drawings in which like numerals refer to like features of the invention.

The present invention provides an efficient method of mass-producing nanometer-sized fiber fibrils for various applications by mechanical working of fibers. The term "fiber" means a solid that is characterized by a high aspect ratio of length to diameter. For example, an aspect ratio having a length to an average diameter ratio of from greater than about 2 to about 1000 or more may be using in the generation of nanofibers according to the instant invention. The term "fibrillated fibers" refers to fibers bearing sliver-like fibrils distributed along the length of the fiber and having a length to width ratio of about 2 to about 100 and having a diameter of less than about 1000 nanometers. Fibrillated fibers extending from the fiber, often referred to as the "core fiber," have a diameter significantly less that the core fiber from which the fibrillated fibers extend. The fibrils extending from the core fiber preferably have diameters in the nanofiber range of less than about 1000 nanometers. As used herein, the term nanofiber means a fiber, whether extending from a core fiber or separated from a core fiber, having a diameter less than about 1000 nanometers. Nanofiber mixtures produced by the instant invention typically have diameters of about 50 nanometers up to less than about 1000 nm and lengths of about 0.1-6 millimeters. Nanofibers preferably have diameters of about 50-500 nanometers and lengths of about 0.1 to 6 millimeters.

The initial step in producing nanofibers is creating the fibrillated fibers having fiber cores and attached nanofiber fibrils. Such fibrillated fibers may be produced by shearing fibers in the manner described in the prior art, which shearing may include a degree of refining, crushing, beating, cutting, mechanical agitation and high shear blending. Alternatively, such fibrillated fibers may be produced by shearing without substantial crushing, beating and cutting in the manner described in U.S. Pat. No. 7,566,014, entitled "Process for Producing Fibrillated Fibers" by the same inventors filed on even date herewith, the disclosure of which is hereby incorporated by reference. This process preferably involves first open channel refining fibers at a first shear rate to create fibrillated fibers, and subsequently open channel refining the fibers at a second shear rate, higher than the first shear rate, to increase the degree of fibrillation of the fibers. The end result of either the prior art or alternate process is that the fibers are broken down into fiber cores and attached fibrils without cutting the fibers cores.

As used herein, the term open channel refining refers to physical processing of the fiber, primarily by shearing, without substantial crushing, beating and cutting, that results in fibrillation of the fiber with limited reduction of fiber length or generation of fines. Substantial crushing, beating and cutting of the fibers is not desirable in the production of filtration structures, for example, because such forces result in rapid disintegration of the fibers, and in the production of low quality fibrillation with many fines, short fibers and flattened fibers that provide less efficient filtration structures when such fibers are incorporated into the paper filters. Open channel refining, also referred to as shearing, is typically performed by processing an aqueous fiber suspension using one or more widely spaced rotating conical or flat blades or plates. The action of a single moving surface, sufficiently far away from other surfaces, imparts primarily shearing forces on the fibers in an independent shear field. The shear rate varies from a low value near the hub or axis of rotation to a maximum shear value at the outer periphery of the blades or plates, where maximum relative tip velocity is achieved. However, such shear is very low compared to that imparted by common surface refining methods where two surfaces in close proximity are caused to aggressively shear fibers, as in beaters, conical and high speed rotor refiners, and double disk refiners. An example of the latter employs a rotor with one or more rows of teeth that spins at high speed within or against a stator.

By contrast, the term closed channel refining refers to physical processing of the fiber by a combination of shearing, crushing, beating and cutting that results in both fibrillation of the fiber and reduction of fiber size and length, and a significant generation of fines compared to open channel refining. Closed channel refining is typically performed by processing an aqueous fiber suspension in a commercial beater or in a conical or flat plate refiner, the latter using closely spaced conical or flat blades or plates that rotate with respect to each other. This may be accomplished where one blade or plate is stationary and the other is rotating, or where two blades or plates are rotating at different angular speeds or in different directions. The action of both surfaces of the blades or plates imparts the shearing and other physical forces on the fibers, and each surface reinforces the shearing and cutting forces imparted by the other. As with open channel refining, the shear rate between the relatively rotating blades or plates varies from a low value near the hub or axis of rotation to a maximum shear value at the outer periphery of the blades or plates, where maximum relative tip velocity is achieved.

In the preferred embodiment of the present invention, the fibrillated fibers and nanofibers are produced in continuously agitated refiners from materials such as cellulose, acrylic, polyolefin, polyester, nylon, aramid and liquid crystal polymer fibers, particularly polypropylene and polyethylene fibers. In general, the fibers employed in the present invention may be organic or inorganic materials including, but not limited to, polymers, engineered resins, ceramics, cellulose, rayon, glass, metal, activated alumina, carbon or activated carbon, silica, zeolites, or combinations thereof. Combination of organic and inorganic fibers and/or whiskers are contemplated and within the scope of the invention as for example, glass, ceramic, or metal fibers and polymeric fibers may be used together.

The quality of the fibrillated fibers and nanofibers produced by the present invention is measured in one important aspect by the Canadian Standard Freeness value. Canadian Standard Freeness (CSF) means a value for the freeness or drainage rate of pulp as measured by the rate that a suspension of pulp may be drained. This methodology is well known to one having skill in the paper making arts. While the CSF value is slightly responsive to fiber length, it is strongly responsive to the degree of fiber fibrillation and fiber diameter distribution. Thus, the CSF, which is a measure of how easily water may be removed from the pulp, is a suitable means of monitoring the degree of fiber fibrillation and fiber diameter distribution. If the surface area is very high, which means generation of many nanofibers or nanofibrils on the surface of core fibers, then very little water will be drained from the pulp in a given amount of time and the CSF value will become progressively lower as the fibers fibrillate more extensively.

Following the production of the fibrillated fibers having fiber cores and attached nanofiber fibrils, the fibrillated fibers are then subjected to processing to strip or otherwise remove the nanofibers from the core. At the end of this stage, there results a mixture of nanofibers and larger fiber cores. Preferably, the present invention produces nanofibers with very small quantities of such remaining fiber cores. This may be achieved by separating the fiber cores from the nanofibers, for example, by filtration or centrifuging, or other classification technologies. Alternatively, the fiber cores are further processed to produce additional nanofibers, preferably while still mixed with the originally stripped nanofibers, by breaking down the fiber cores by closed channel shearing. In this latter case, the nanofiber fibrils escape being further cut down to fines because shear forces employed remain insufficient to cut and destroy the small separated fibrils. The invention therefore produces high quality nanofibers without significant deterioration of the fibrils into low value shorter whiskers or fines.

Preferably, the fibrillated fibers have a CSF rating of 200 to 0, or 100 or lower, and are subjected to a two stage closed channel refining to separate nanofibers from original fiber cores. The preferred first stage of the closed channel refining is a low speed, high shear closed channel refining followed by high speed, high shear refining. The entering fibrillated fiber is an aqueous suspension having a concentration in the range of 0.1% to 25% by weight. In this first step, the nanofibers are stripped off the core fiber and the core fiber is refined further. This mixture of separated nanofibers and core fibers is then preferably fed to a second stage closed channel refining with very high shear. During this second stage closed channel refining, the fiber core is further refined to produce more nanofibers without substantially affecting already separated nanofibers. The resulting fiber mixture may then be fed back to the first stage closed channel refining and/or the second stage closed channel refining and processed again until substantially all the fiber cores are transformed into nanofibers, to yield a nanofiber slurry which has substantially reduced original fiber cores.

A preferred continuous arrangement of open and closed channel refiners is depicted in FIG. 1, wherein refiners 70, 90 and 100 are shown in series. Refiner 70 is an open channel refiner having a jacketed, water cooled vessel housing 42 enclosing rotors 52. Refiners 90 and 100 are closed channel refiners which may have jacketed, water cooled vessel housings 63 and enclose rotors 62 and 72, respectively. Additional open channel refiners may be provided in series prior to refiner 70. Each refiner has a motor 46 operatively attached to a shaft 44 on which is mounted the blades, plates or rotors. The terms rotors shall be used interchangeably for blades or plates, unless otherwise specified.

Figure 2:
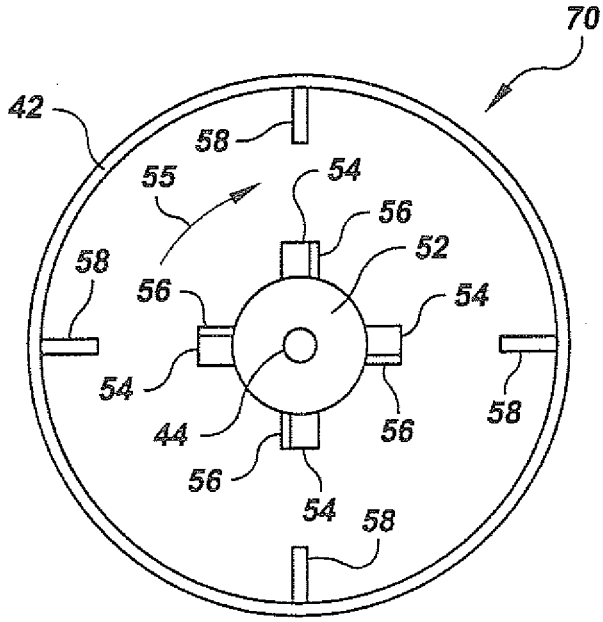
FIG. 2 is a top plan view, in partial cross-section, of a rotor in an open channel refiner of FIG. 1.

Open channel refiner 70 includes at least one, and preferably more than one horizontally extending rotors 52 spaced-apart vertically on shaft 44. The rotors may vary in diameter, and preferably achieve a tip speed (i.e., speed at the outer diameter of rotor) of at least 7000 ft/min. (2100 m/min). The rotors may contain teeth whose number may vary, preferably from 4 to 12. FIG. 2 shows a possible rotor configuration in refiner 70, similar to that of a Daymax blender available from Littleford Day Inc. of Florence, Ky. Rotor 52 is centrally mounted on shaft 44 and has extending radially therefrom a plurality of teeth 54, of which four are shown in this example. Rotor 52 rotates in direction 55, and sharpened edges 56 are provided on the leading edges of teeth 54. Baffles 58, partially radially inward extending from housing 42, help to impart turbulent mixing to the fiber suspension during the open channel refining.

Closed channel refiners 90 and 100 follow open channel refiner 70 in process order, and the preferred embodiments of the former are shown in FIGS. 3-6. As shown in more detail in FIGS. 3 and 4, a relatively lower shear closed channel refiner 90 is similar to a Valley beater and receives the incoming fiber suspension 80 onto an oval track 94 within housing 92. A cylindrical rotor or beater 62 has geartooth-like beater bars 64 extending outwardly from the periphery in a direction parallel to central shaft 44. Rotor 62 rotates in direction 97 (FIG. 4), and forces the fiber suspension 81 being processed between the teeth or bars 64 and the track to achieve the desired degree of closed channel, high shear refining. The degree of shear applied to the fiber in the suspension may be adjusted by changing the gap distance x between the edges of beater bars 64 and the track, or by adjusting the amount of force applied to the rotor 62 in the direction of the track. The track curves upward 95 for a portion of the periphery of rotor 62 to increase the area over which the high shear forces are applied, after which the track curves back downward 96 to permit the fiber suspension to flow back around in direction 98 to be reprocessed through rotor 62. A portion of track area 95 below rotor 62 may be made of a flexible, rubber diaphragm. After the fiber suspension is processed to a desired degree, it exits 82 from closed channel refiner 90. Typically at this point the original nanofiber fibrils are substantially separated from the fiber core, and the fiber core itself is partially chopped and sheared into nanofiber sized fibers.

Figure 5:
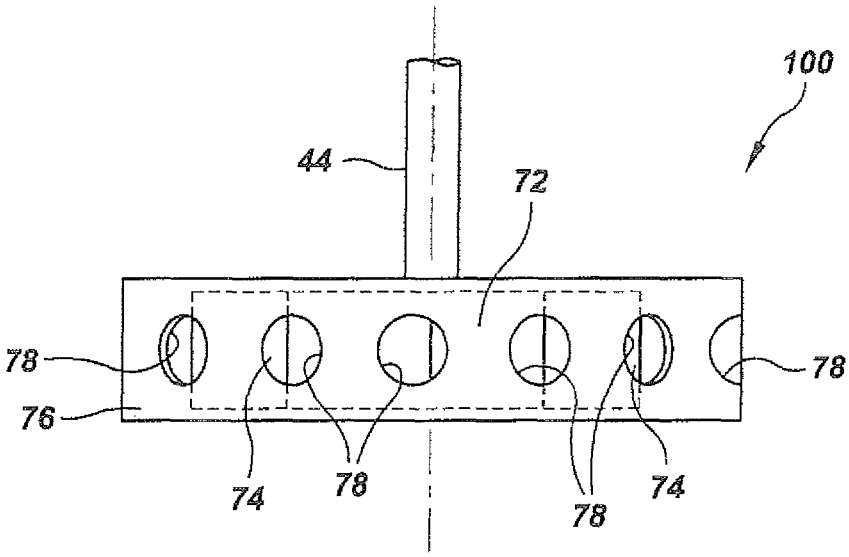
FIG. 5 is a side elevational view of a second closed channel refiner of FIG. 1 which imparts a relatively higher level of shear refining.
Figure 6:
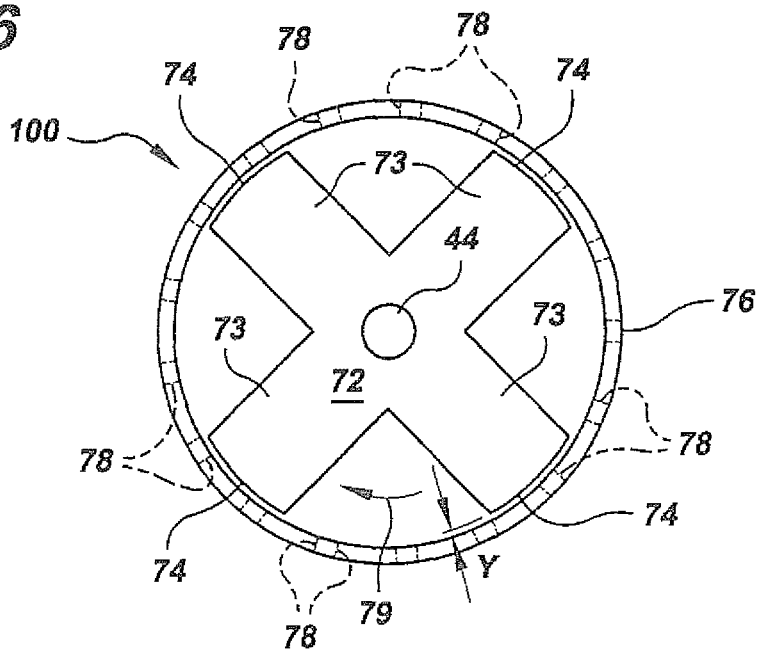
FIG. 6 is a top plan view of the rotor and stator portions of the closed channel refiner of FIG. 5.

The fiber suspension may then be further processed in a higher shear closed channel refiner 100, as shown in more detail in FIGS. 5 and 6. Refiner 100 may be similar to a Ross high shear mixer available from Charles Ross and Son Company of Hauppauge, N.Y. or a Silverson mixer available from Silverson Machines Ltd. of Chesham Bucks, U.K. A rotor 72 is driven by shaft 44 to rotate in direction 79 (FIG. 6) with respect to a stationary cylindrical stator 76 which has a series of spaced openings 78 around the periphery, the edges of which act as stationary teeth. Rotor 72 is shown with four radially extending arms or teeth 73 that end in faces 74 that are separated by a desired gap y, for example, 0.050 in (1.3 mm), from the inside surface of stator 76. Any combinations of number of rotor teeth and stator openings may be utilized as needed to achieve the desired high degree of shearing of the fibers between the rotor face and stator opening edges. The rotor and stator are immersed in a fiber suspension in a housing within closed channel refiner 100 for a desired time period to chop and shear the remaining fiber cores into nanofiber sized fibers. The original nanofibers created in earlier refining are not substantially affected by processing in high shear refiner 100.

In rotary processing equipment such as the open and closed channel refiners of FIGS. 1-6, maximum shear rate at the outer periphery of the rotating blades or plates may be increased by changing the physical design of the rotor surface, by increasing the angular velocity of the rotor, or by increasing the diameter of the rotor. The rate of shear increases from a minimum to maximum as the tip velocity of the rotor increases.

Optionally, the fiber suspension may be processed by pressurizing the suspension in a homogenizer and forcing the pressurized suspension through a small nozzle or orifice to further transform substantially all the fiber cores into nanofibers by cell disruption. This homogenization subjects the fibers to high shear forces, and may be performed after one or both of the closed channel refiner processing described above, or in place of such processing. The homogenizer may be used with (e.g., after), or in place of, the closed channel refiners shown in FIGS. 3-6.

Figure 7:
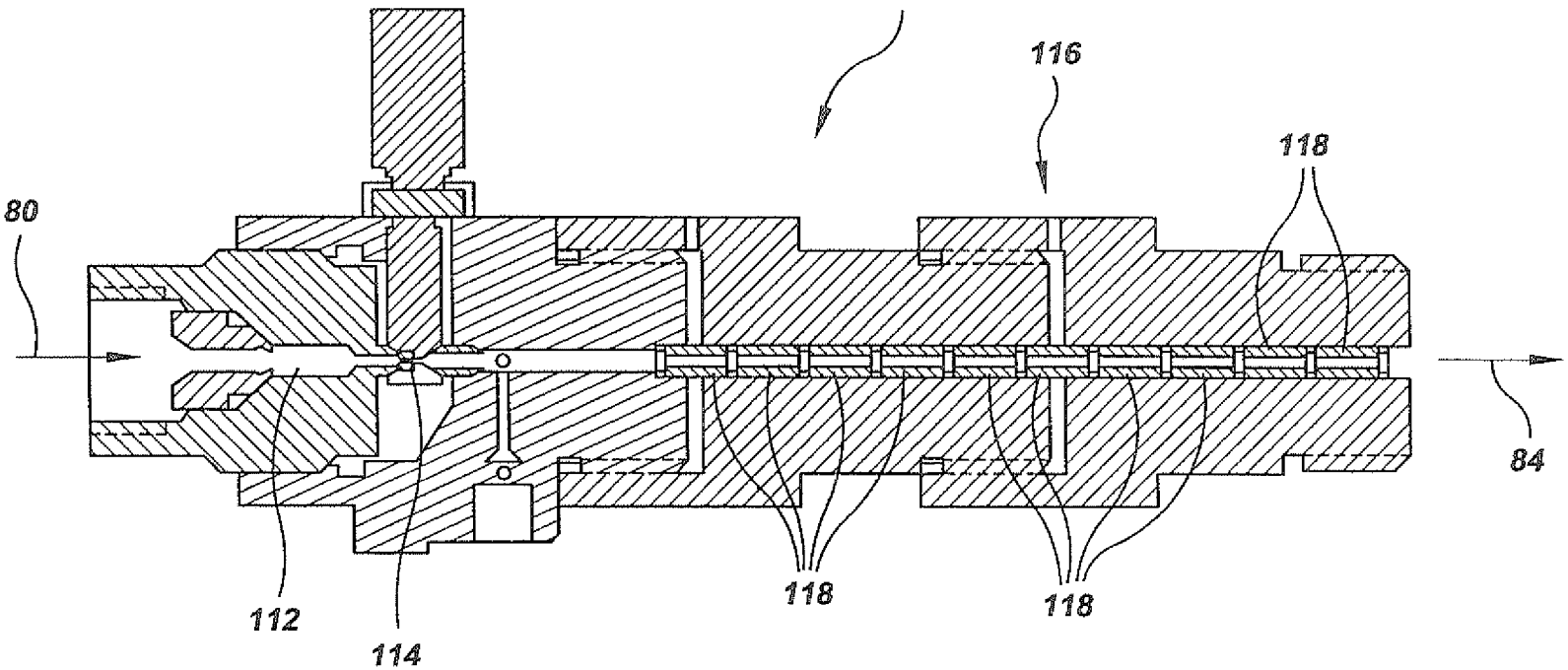
FIG. 7 is a cross-sectional view of a homogenizing cell which may be used with or in place of the closed channel refiners of FIGS. 3-6 in the system of FIG. 1.

As shown in FIG. 7, homogenizer 110 (also referred to as a homogenizing cell) consists of a pretreatment coupling 112, nozzle assembly 114 and an absorption cell. The fiber slurry 80, typically with CSF 0, is fed into the inlet chamber of a homogenizing cell 116 at a high pressure. The pre-treatment coupling is used to control the cavitation before the fibers enter the nozzle. The fibers become well dispersed in the pre-treatment zone 112 and are forced through nozzle 114. The nozzle diameter can be changed to control viscosity, flow rate, pressure and cavitation so as to cause optimum cell disruption. Typical nozzle diameter is 0.2 mm. A very high shear is exerted on the fibers as they pass through the nozzle. The pressure on the fiber slurry may be controlled between about 2000 and 45000 psi (15 and 300 Mpa). The slurry exiting from nozzle enters absorption cell 116, shown having 10 reactors 118 of 2 mm length each, which are used to absorb the kinetic energy. As the fiber slurry exits the nozzle, cavitation causes the nanofibers to separate from the core fiber and further disrupt the core fiber to smaller fibers. In the absorption cell 116 the kinetic energy is absorbed. The length and diameter of absorption cell can be changed to control the process time and turbulence. The resulting slurry 84 may be fed back into the inlet for multiple passes through the homogenizer. The direction of flow can also be reversed inside the absorption cell to cause more turbulence, which in turn causes fibers to separate.

Figure 8:
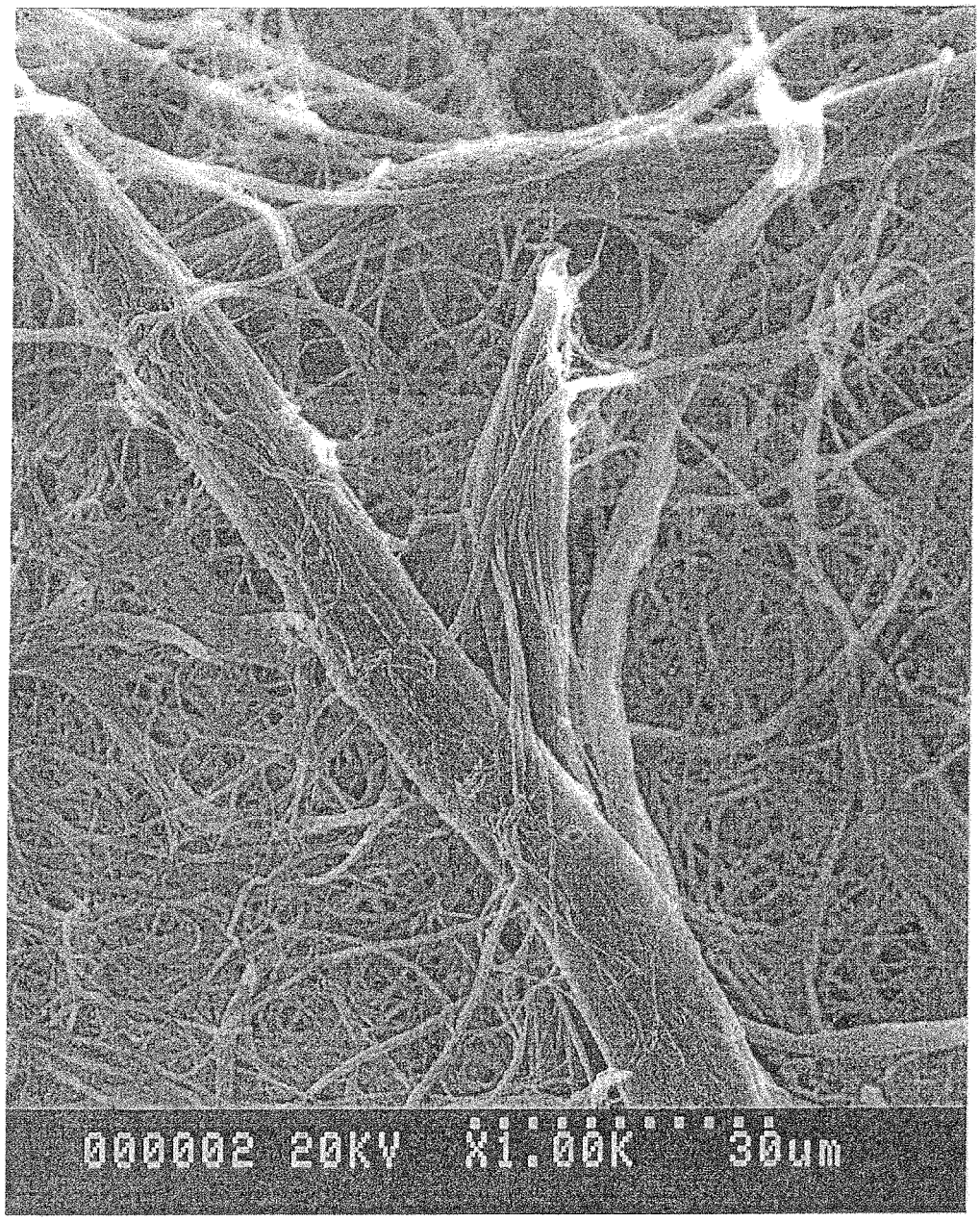
FIG. 8 is a photomicrograph of a fiber with nanofiber-sized fibrils.

Referring back to FIG. 1, the process of making fibrillated fibers begins by feeding an aqueous suspension of fibers 38 into open channel refiner 70. The starting fibers have a diameter of a few microns with fiber length varying from about 2-6 mm. The fiber concentration in water can vary from 1-6% by weight. After open channel refining 70, the fibrillated fiber 80 is characterized by Canadian Standard Freeness rating of the fiber mixture, and by optical measurement techniques. Typically, entering fibers have a CSF rating of about 750 to 700, which then decreases with each stage of refining to a preferred final CSF rating of about 400 to 0. The finished fibrillated fiber product obtained at the end of processing has most of the nanofibers or fibrils still attached to the core fibers, as shown in FIG. 8.

Figure 9:
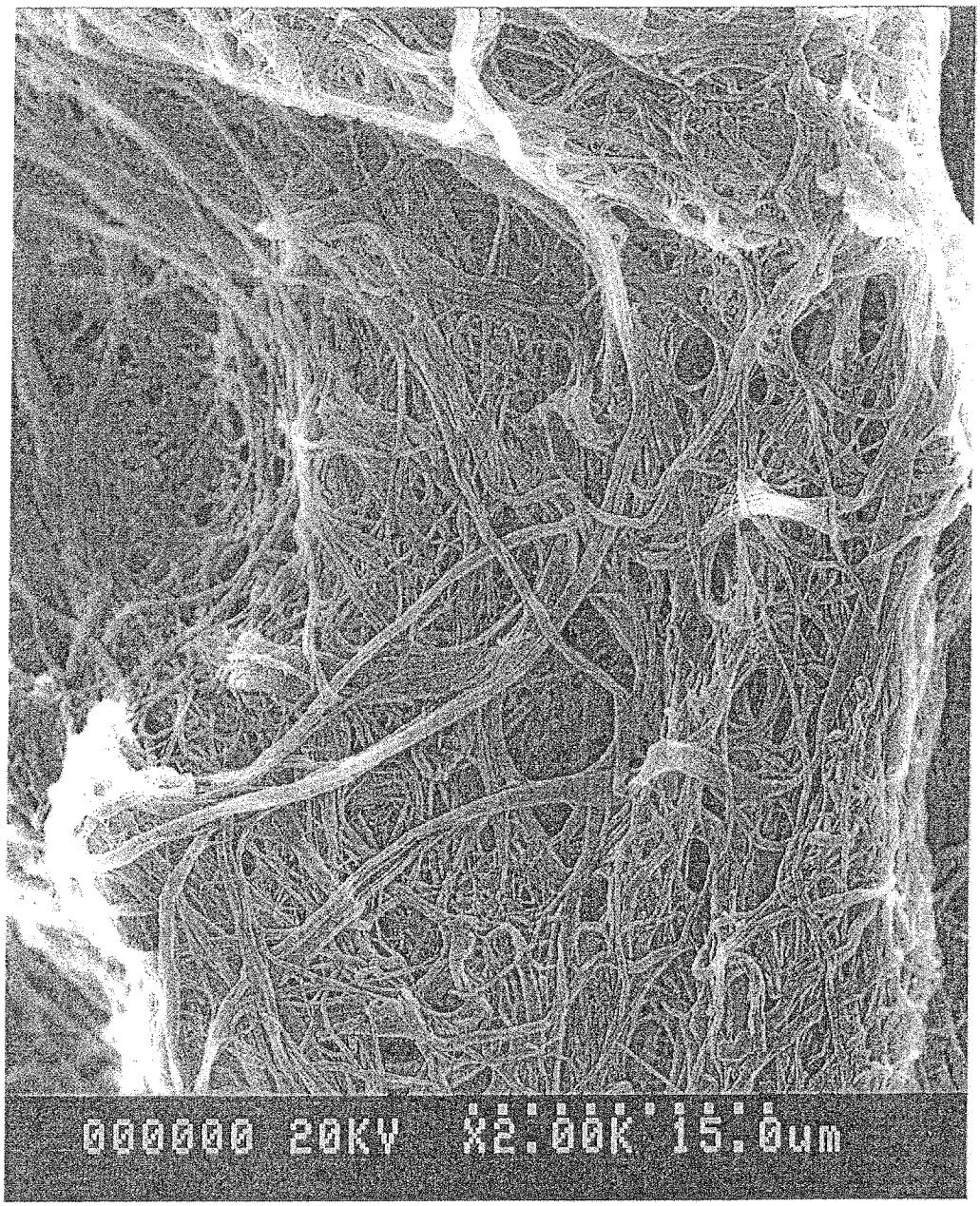
FIG. 9 is a photomicrograph showing nanofibers separated from fiber cores in accordance with the present invention.
Figure 10:
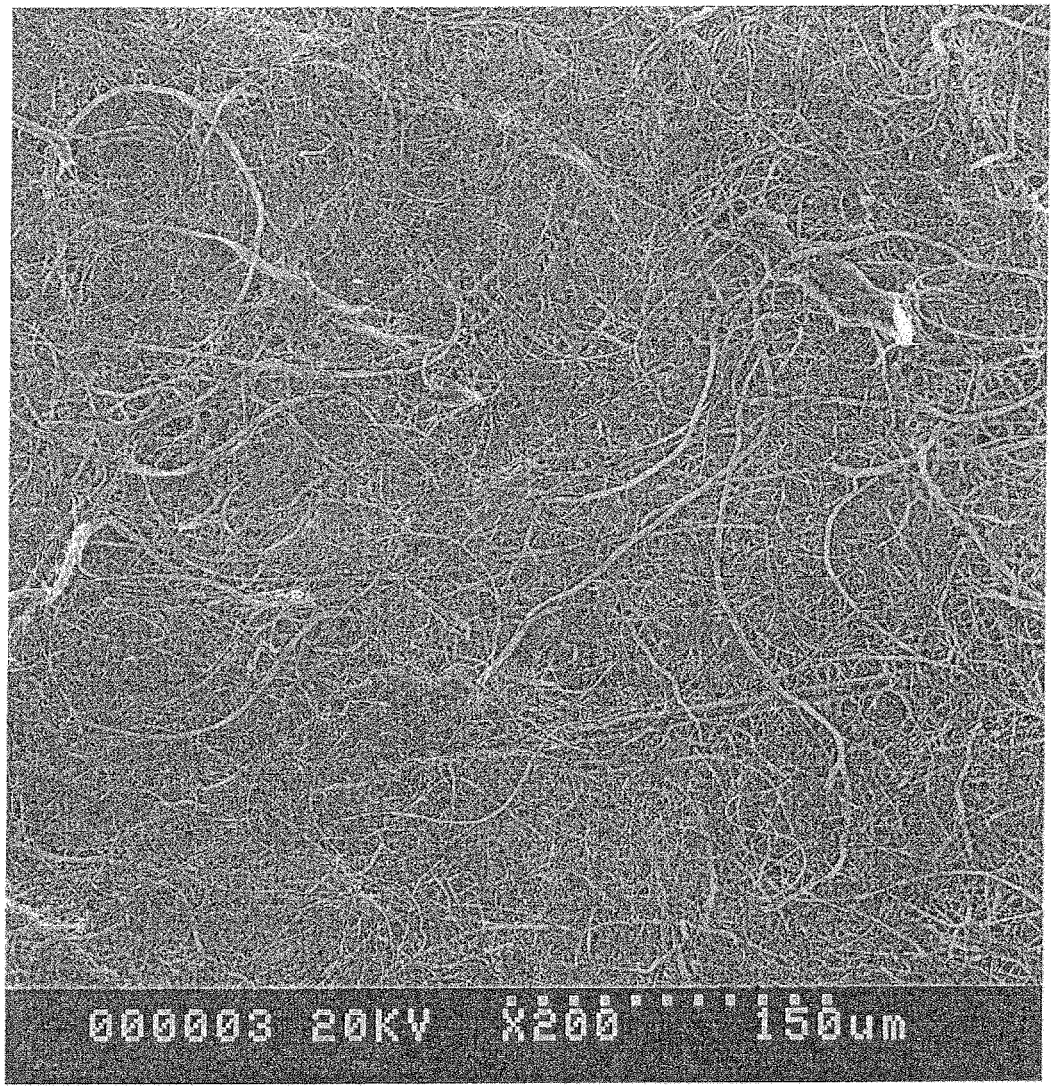
FIG. 10 is a photomicrograph of nanofibers separated from fiber cores and broken down from fiber cores in accordance with the present invention.

The open channel refiner 70 is fed continuously with fibers 38 and, after open channel refining therein for a desired time, the resulting fibrillated fiber suspension 80 preferably continuously flows to succeeding closed channel refiner 90, where it is closed channel refined at a relatively low shear rate to remove the attached nanofibers from the fiber cores. For example, the rotor speed at this first stage closed channel refining can vary from about 400 to 1800 rev./min. The partially processed fiber suspension 82 then flows from closed channel refiner 90 to closed channel refiner 100, where it is further closed channel refined at a greater shear rates in continuous mode operation. For example, the rotor speed at this second stage closed channel refining can vary from about 400 to 3600 rev./min. A mixture of fiber cores and nanofibers separated from fiber cores as produced by the closed channel refining is shown in FIG. 9. The degree of closed channel refining may be increased by increasing the rate of shearing, beating and cutting, for example, by increasing the rotor speed or rotor diameter, or time in a refiner, to further refine the fiber core to produce more nanofibers without substantially affecting already separated nanofibers. The finished nanofiber suspension 84 emerges from refiner 100. Nanofibers at this stage, comprising a mixture of fibrils separated from fiber cores and fibers broken down from fiber cores, are shown in FIG. 10.

If desired or required, the fiber suspension may be further processed by returning the fibrillated fiber suspension 80, partially processed nanofiber suspension 86, or finally processed nanofiber suspension 88 as recycle 32 to previous refiner stages 70, 90 and/or 100 for additional open and/or closed channel refining.

The rate at which the fibers are fed into first refiner 70 is governed by the specifications of the final fibrillated fiber 84. The feed rate (in dry fibers) can typically vary from about 20-1000 lbs./hr. (9-450 kg/hr), and the average residence time in each refiner varies from about 30 min. to 2 hours. The number of sequential refiners to meet such production rates can vary from 2 up to 10. The temperature inside the refiners is usually maintained below about 175° F. (80° C.).

The processed nanofiber 84 is characterized by Canadian Standard Freeness rating of the fiber mixture, and by optical measurement techniques. Typically, entering fibrillated fibers 80 have a CSF rating of about 50 to 0. Although the final CSF rating of the processed nanofiber 84 is still about 0, optical measurement shows that the fibrils are separated from the fiber cores and the fiber cores are broken down into nanofibers as a result of the high shear forces in the closed channel refining and/or homogenization proceeds.

EXAMPLE 1

Figure 3:
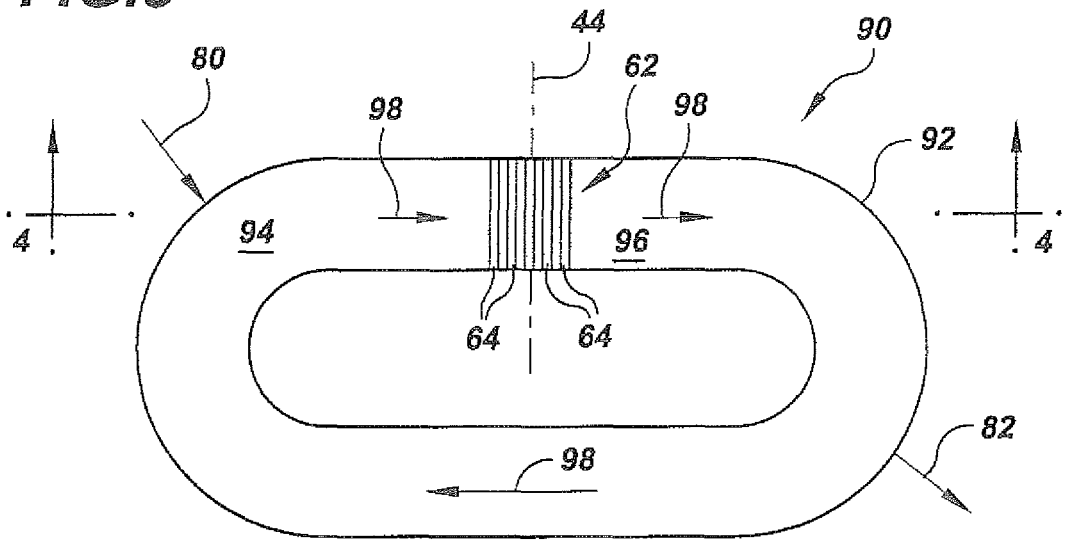
FIG. 3 is a top plan view of a first closed channel refiner of FIG. 1 which imparts a relatively lower level of shear refining.
Figure 4:
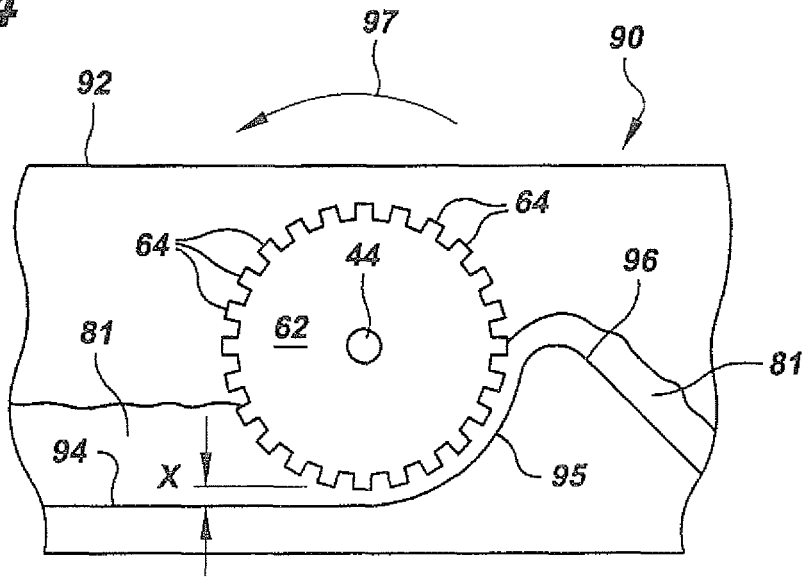
FIG. 4 is a side elevational view, partially in cross-section, of the rotor portion of the closed channel refiner of FIG. 3.

A slurry of fibrillated fibers with CSF 0 is fed into a closed channel low shear refiner of the type shown in FIGS. 3 and 4. The fibrillated fiber slurry has a concentration of about 1.5% solids content by weight. At a rotor speed of about 500 rev./min., the fibrillated fiber slurry is processed for a minimum of 30 to 45 minutes. After the nanofibers have been detached from the fiber cores, and the cores have been partially chopped into nanofibers, the slurry is fed into a closed channel high shear refiner of the type shown in FIGS. 5 and 6. At this stage the unprocessed original fiber cores are refined to generate more nanofibers. At a rotor speed of about 3600 rev./min. the fiber slurry is processed for a minimum of 1 hour. The resulting slurry contains nanofibers with a diameter in the range of about 50 to 500 nm and a fiber length of about 0.5 to 3 mm.

EXAMPLE 2

A fibrillated fiber slurry of about 0.5 wt. % solids content and CSF of 0 is fed into the inlet chamber of a homogenizer of the type shown in FIG. 7. The nanofibers at this stage are primarily still connected to the core fiber. The feed rate is kept at 1 liter/min (2 lbs./hr of dry fiber). The pressurized cell at 20,000 psi (140 MPa) forces the fiber slurry through the nozzle. The nozzle diameter is kept at 0.2 millimeters. The fiber slurry enters the reactors of the absorption cell, which are used to absorb the kinetic energy. The resulting slurry is collected at the end of absorption cell. The slurry is then fed back into the inlet chamber for reprocessing, in about 7 passes, until substantially all the nanofibers are separated and core fibers are converted into nanofibers.

Thus, the present invention provides an improved process and system for producing nanometer-sized fibers having substantially no larger fiber cores mixed therein with greater uniformity and flowability. The fiber cores have a diameter of about 500-5000 nm and a length of about 0.1-6 mm and the nanofibers have a diameter of about 50-500 nm and a length of about 0.1-6 mm. The invention also produces nanometer-sized fibers with greater energy efficient and productivity, resulting in improved volume and yield. Such nanofibers may be used for filtration and other known nanofiber applications.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A process for making nanofibers comprising:

preparing a fluid suspension of fibers;

shear refining the fibers to create fibrillated fibers comprising fiber cores having attached nanofibers extending outwardly therefrom; and subsequently closed channel refining the fibrillated fibers to detach nanofibers from the fibrillated fibers.

2. The process of claim 1 further including substantially separating the detached nanofibers from remaining fibrillated or core fibers.

3. The process of claim 1 wherein the closed channel refining additionally creates nanofibers from the fiber cores.

4. The process of claim 1 wherein the closed channel refining is initially at a first shear rate at a first angular velocity and, subsequently, at a second, higher shear rate and a second, higher angular velocity to detach nanofibers from the fibrillated fibers, leaving fiber cores, and to create additional nanofibers from the fiber cores.

5. The process of claim 1 wherein the closed channel refining of the fibrillated fibers is by shearing, crushing, beating and cutting the fibrillated fibers.

6. The process of claim 1 wherein the fiber suspension flows continuously from the shear refining to the closed channel refining.

7. The process of claim 1 further including removing from the fiber suspension heat generated during the shear refining or closed channel refining.

8. The process of claim 1 wherein the fiber suspension flows continuously and in series from the shear refining to and through the subsequent closed channel refining, and further including controlling the rate of flow of the fiber suspension from the shear refining to the closed channel refining.

9. The process of claim 1 wherein the closed channel refining is performed by passing the fiber suspension between teeth that move relative to one another, the teeth being spaced to impart sufficient shear forces on the fibers in the fiber suspension to detach nanofibers from the fibrillated fibers and optionally create additional nanofibers from the fiber cores.

10. The process of claim 1 further including homogenizing the fibrillated fibers by pressurizing the fiber suspension and passing the pressurized fiber suspension through an orifice of a size and at a pressure to impart sufficient shear forces on the fibers in the fiber suspension to detach nanofibers from the fibrillated fibers and optionally create additional nanofibers from the fiber cores.

11. A process for making nanofibers comprising:

preparing a fluid suspension of fibrillated fibers comprising fiber cores having attached nanofibers extending outwardly therefrom; and closed channel refining the fibrillated fibers initially at a first shear rate and a first angular velocity and, subsequently, at a second, higher shear rate and second, higher angular velocity to detach nanofibers from fiber cores and to create additional nanofibers from the fiber cores.

12. The process of claim 11 wherein the closed channel refining of the fibrillated fibers is by shearing, crushing, beating and cutting the fibrillated fibers.

13. The process of claim 11 wherein the fiber suspension flows from a first rotor operating at the first shear rate to a second rotor operating at the second shear rate.

14. The process of claim 11 wherein the fiber suspension flows continuously from a first rotor operating at the first shear rate to a second rotor operating at the second shear rate.

15. The process of claim 11 wherein the fiber suspension flows continuously and in series from a first rotor operating at the first shear rate to a second rotor operating at the second shear rate, and further including controlling the rate of flow of the fiber suspension.

16. The process of claim 11 further including removing from the fiber suspension heat generated during the closed channel refining.

17. The process of claim 11 closed channel refining is performed by passing the fiber suspension between a pair of teeth that move relative to one another, the teeth being spaced to impart sufficient shear forces on the fibers in the fiber suspension to detach nanofibers from the fibrillated fibers and create additional nanofibers from the fiber cores.

18. The process of claim 11 further including homogenizing the fibrillated fibers by pressurizing the fiber suspension and passing the pressurized fiber suspension through an orifice of a size and at a pressure to impart sufficient shear forces on the fibers in the fiber suspension to detach nanofibers from the fibrillated fibers and create additional nanofibers from the fiber cores.

19. A process for making nanofibers comprising:

preparing a fluid suspension of fibers;

shear refining the fibers to create fibrillated fibers comprising fiber cores having attached nanofibers extending outwardly therefrom; and subsequently homogenizing the fibrillated fibers by forcing the fibrillated fibers under pressure through an orifice to detach nanofibers from the fibrillated fibers.

20. The process of claim 19 further including substantially separating the detached nanofibers from remaining fibrillated or core fibers.

21. The process of claim 19 wherein the homogenizing additionally creates nanofibers from the fiber cores.

22. The process of claim 19 wherein the fiber suspension flows continuously from the shear refining to the homogenizing.

23. The process of claim 19 further including removing from the fiber suspension heat generated during the shear refining or homogenizing.

24. The process of claim 19 wherein the fiber suspension flows continuously and in series from the shear refining to and through the subsequent homogenizing, and further including controlling the rate of flow of the fiber suspension from the shear refining to the homogenizing.

25. A process for making nanofibers comprising:

preparing a fluid suspension of fibrillated fibers comprising fiber cores having attached nanofibers extending outwardly therefrom; and homogenizing the fibrillated fibers by forcing the fibrillated fibers under pressure through an orifice initially at a first shear rate and, subsequently, at a second, higher shear rate to detach nanofibers from fiber cores and to create additional nanofibers from the fiber cores.

26. The process of claim 25 further including removing from the fiber suspension heat generated during the homogenizing.

* * * * *

UNITED STATES PATENT AND TRADEMARK OFFICE

CERTIFICATE OF CORRECTION

PATENT NO. : 8,444,808 B2
APPLICATION NO. : 11/694087
DATED : May 21, 2013
INVENTOR(S) : Evan E. Koslow and Anil C. Suthar It is certified that error appears in the above-identified patent and that said Letters Patent is hereby corrected as shown below:

Title Page

Assignee: item (73) delete: "KX Industries, LP, Orange, CT (US)"

substitute therefore: - "KX Technologies LLC, West Haven, CT (US)"

Signed and Sealed this
Fourth Day of March, 2014

Michelle K. Lee

Michelle K. Lee
*Deputy Director of the United States Patent and Trademark Office*